United States Patent [19]

Turta et al.

[11] 4,343,362

[45] Aug. 10, 1982

[54] RECOVERY OF OIL FROM AN OIL RESERVOIR BY MISCIBLE DISPLACEMENT

[75] Inventors: Alexandru Turta; Marius Cucuiat, both of Cimpina, Romania

[73] Assignee: Institutul de Cercetari si Proiectari Pentru Petrol si Gaze, Cimpina, Romania

[21] Appl. No.: 116,551

[22] Filed: Jan. 29, 1980

[51] Int. Cl.[3] ..... E21B 43/22; E21B 43/20

[52] U.S. Cl. ..... 166/267; 166/274; 166/305 R

[58] Field of Search ..... 166/265, 266, 267, 263, 166/273, 274, 305 R

[56] References Cited

U.S. PATENT DOCUMENTS

| | | | |
|---|---|---|---|
| 2,623,596 | 12/1952 | Whorton et al. | 166/274 |
| 3,003,554 | 10/1961 | Craig, Jr. et al. | 166/274 |
| 3,065,790 | 11/1962 | Holm | 166/274 |
| 3,084,743 | 4/1963 | West et al. | 166/274 X |
| 3,228,467 | 1/1966 | Schlinger et al. | 166/266 |
| 3,240,271 | 3/1966 | Ortloff | 166/274 X |
| 3,266,569 | 8/1966 | Sterrett | 166/263 |
| 3,295,601 | 1/1967 | Santourian | 166/263 |
| 3,811,501 | 5/1974 | Burnett et al. | 166/274 X |
| 3,995,693 | 12/1976 | Cornelius | 166/263 X |
| 4,007,785 | 2/1977 | Allen et al. | 166/263 |

*Primary Examiner*—James A. Leppink
*Assistant Examiner*—George A. Suchfield
*Attorney, Agent, or Firm*—Karl F. Ross

[57] ABSTRACT

Oil from an oil reservoir and subsequently from several oil reservoirs is recovered by injecting, in a first stage, a displacement agent in a gaseous state into the oil reservoir. Afterwards, in a second stage, there is withdrawn 90% of the displacement agent from the oil reservoir together with water through the wells. In a third stage there is injected into a second oil reservoir this withdrawn displacement agent, after water separation and drying and compression of the agent. As in the aforementioned stages 1–3 there is withdrawn from the second oil reservoir 90% from the displacement agent left in this oil reservoir which may be injected into the third oil reservoir, etc. The entire (overall) amount of the displacement agent used is half of the amount used according to previously known processes. At the end one recovers the used displacement agent. Initially one may even use a mixture of displacement agent with impurities that are purged by the injection process itself in the first oil reservoir.

6 Claims, 1 Drawing Figure

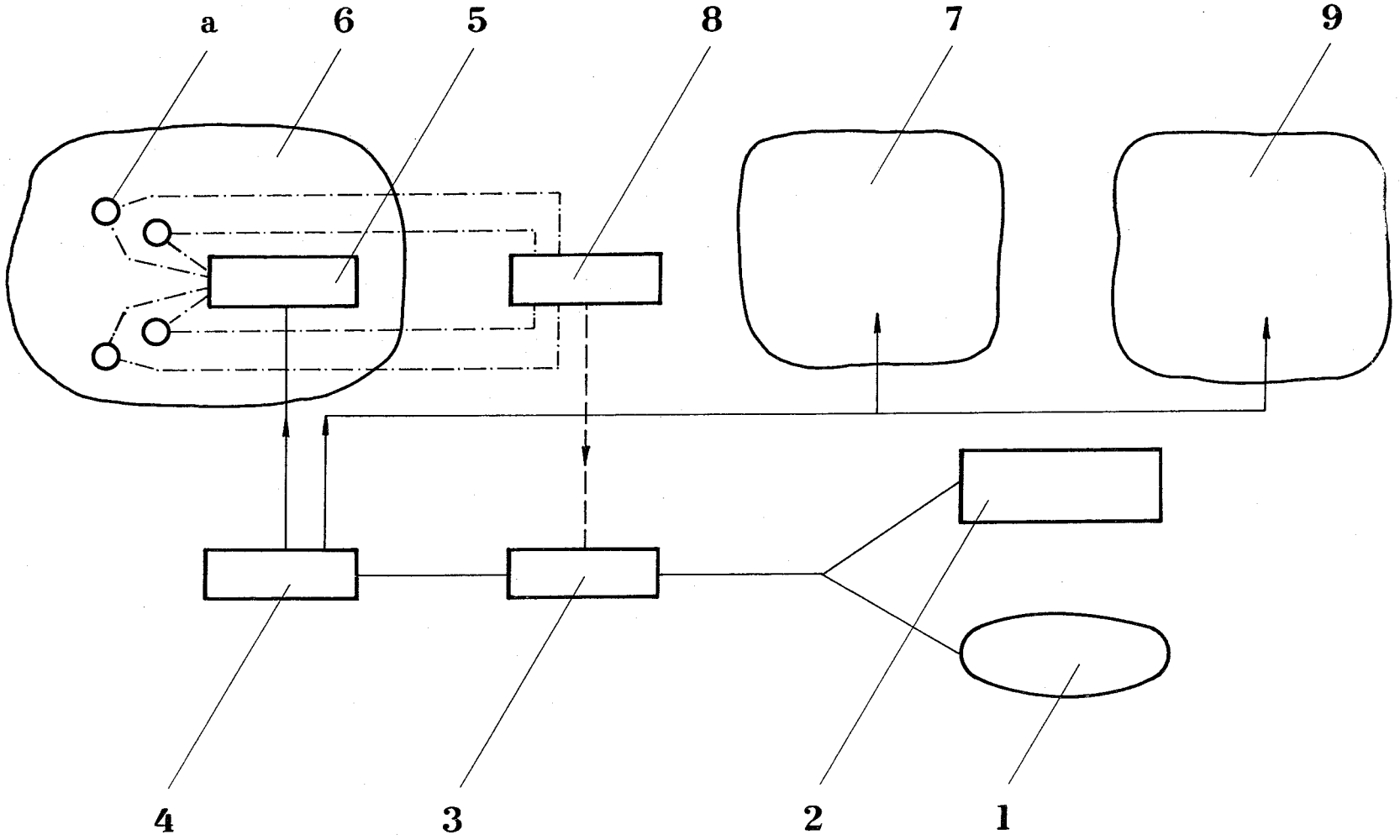
9
7
8
5
6
a
1
2
3
4

RECOVERY OF OIL FROM AN OIL RESERVOIR BY MISCIBLE DISPLACEMENT

FIELD OF THE INVENTION

The patent relates to recovery of oil from depleted oil reservoirs by a miscible displacement process using displacement agents such as pure carbon dioxide or gaseous mixtures with carbon dioxide, for instance mixtures of methane, propane, lean gases, rich gases or ammonia with carbon dioxide obtained from natural sources or from gas processing plants which are in a gaseous state under reservoir conditions.

BACKGROUND OF THE INVENTION

There are known recovery processes for oil from oil reservoirs by a miscible displacement process, which include the injection, at least in one well of an oil reservoir, of a quantity of a miscible displacement agent, consisting of carbon dioxide, equal to about 20% of the saturated-pore volume of hydrocarbon. Next an air slug can be injected, this air slug replacing the displacement agent left in the oil reservoir by residual saturation of the water flood area. Then continuous injection of water is undertaken, the oil reservoir fluid being withdrawn through other wells.

The disadvantage of these processes is that it is necessary to use rather large amounts of the displacement agent of which about 90% remains in the oil reservoir. In the case of an oil reservoir having a certain heterogenous degree of air blended with the oil, the displacement agent suffers a miscibility loss across a certain section of the displacement front.

SUMMARY OF THE INVENTION

The process, according to the invention, does away with the above-mentioned disadvantages in that towards the end of the oil displacement process, through some injected wells which penetrate a section or block of an oil reservoir, there is withdrawn the displacement agent, left in the section or block of the oil reservoir as residual saturation dissolved in water. Afterwards, only the displacement agent is compressed and is injected through at least one well in another section or block of the same oil reservoir or another oil reservoir—in a miscible displacement of agent with oil—this injection being followed by a conventional continuous injection of water. Towards the end of the oil displacement process through this injected well, the displacement agent is withdrawn together with water, the displacement agent being compressed for injection through another well in another section or block of the same oil reservoir or another oil reservoir, in this case the miscibility conditions being also maintained, this injection also being followed by the conventional continuous injection of water, towards the end of which the displacement agent together with water is withdrawn, and in this case, only the displacement agent being used for the oil miscible displacement or for other industrail purposes. After the withdrawal of the displacement agent and water by natural flow, gas-lift or deep-well pumping from still another well injection, the agent separated from the water is complemented with a new amount of agent if necessary, dried and then compressed for injection in another section or block of the same oil reservoir or another reservoir; and in a working version when using an impurities and displacement agent mixture—carbon dioxide with over 20% methane or nitrogen, or other gaseous impurities—there is necessary a higher initial injection pressure, after which the carbon dioxide recovery from the first oil reservoir and then from the second one—in which the displacement agent from the first oil reservoir has been injected—the injection pressure of the displacement agent in the following oil reservoir decreases in accordance with the pure agent miscibility pressure.

The process, according to the invention, may be applied in the case of oil secondary or tertiary recovery from one or more oil reservoirs and includes the injection through at least one well in the oil reservoir—divided or not divided into patterns of 5, 7 or more section—or into a block of an oil reservoir—which is separated from the other blocks by sealed faults, at the miscibility pressure corresponding to the petroleum composition and the oil-reservoir temperature, of a displacement agent in a gaseous state. Under oil-reservoir conditions, the displacement agent consists of pure carbon dioxide or carbon dioxide in a mixture, for instance, with methane, propane, lean gases, rich gases or ammonia. The displaced fluid is withdrawn through at least one well. This fluid contains carbon dioxide—about 10% of the displacement agent is withdrawn in mixture with light oil fractions in a concentration of 1 to 2% to 60 to 70% in volume—which, if necessary, may be used again, associated with the oil-reservoir gases or after being recovered, added to the miscible agent injection in the oil reservoir. After the displacement agent slug injection, the conventional continuous injection of water is used to displace the oil and displacement agent mixture. Towards the end of the oil displacement process from the pattern block or oil reservoir, there is withdrawn through the injection well in a way already known, such as for instance through natural flow, gaslift or pumping, the injected fluid, namely about 90% of the displacement agent left in the oil reservoir—in the form of residual saturation dissolved in water—and injection water.

This withdrawn fluid is separated, and the carbon dioxide which results is dried, compressed and injected, with an eventual additional amount through at least one well in another pattern or block of the same oil reservoir or another oil reservoir. Afterwards, to effect miscible slug displacement a conventional continuous injection of water is added through at least one other well. Towards the end of the oil displacement process, there is withdrawn through natural flow, gaslift or pumping, the injected fluid, namely about 90% of the displacement agent left in the oil reservoir and the injection water. This withdrawn fluid is separated, and the carbon dioxide which results is dried and compressed and injected through at least one well in another pattern or block of the same oil reservoir or another oil reservoir, the detailed stages being repeated as before. The displacement agent amount which is recovered, is augmented, if necessary, with a new amount of agent and then is injected once again.

The agent injection should begin in the most homogenous oil reservoir, with the largest volume of hydrocarbon—saturated porous rock, where the miscibility conditions are accomplished at the lowest pressure.

In another working version of the process, according to the invention, when the displacement agent contains impurities, for instance over 20% methane or ammonia, or other gaseous impurities, the injection pressure in the first oil reservoir is relatively high and decreases in proportion as the displacement agent is several times recovered and injected in another oil reservoir. This miscibility depression of the agent is due to the impurities, in general being less soluble, which separate during the displacement process by their passing through the displacement front created with the oil. In this way a gases separation takes place and a displacement agent without impurities is obtained after the first or second agent withdrawal from the oil reservoir in which the displacement agent has been injected.

BRIEF DESCRIPTION OF THE DRAWING

The above and other features and advantages of the invention will become more readily apparent from the following descriptive examples reference being made to the sole FIGURE of the accompanying drawing, in which a flow diagram according to the process of the invention is shown.

SPECIFIC DESCRIPTION

EXAMPLE 1

According to a working example of the invention, from an oil reservoir 1 there is withdrawn a displacement agent, minimum 80% concentrated, through some wells non-indicated in the figure—or the displacement agent may be taken from a gas processing plant 2, and is dried in a drying unit 3 for reducing the water content and then fed into compression station 4. The dried and compressed displacement agent is then passed through a distributor 5, from which through one or more wells a, it is injected into an oil reservoir 6. The displacement agent slug is displaced through the oil reservoir 6 by the conventional continuous stream of water injected in the oil reservoir through the wells a. Towards the end of the oil miscible displacement process, the mixture is withdrawn through the same wells a through which the displacement agent had been injected, and about 90% of this agent, left in the oil reservoir 6 as residual saturation and dissolved in water, together with water, is recovered. The displacement agent withdrawal through the same wells a through which it was initially injected into the oil reservoir 6, is aided by natural flow of the two-phase mixture of water and displacement agent, gaslift or water deep-pumping, the displacement agent being withdrawn through an annular space between a casing column and a tubing, non-represented in the FIGURE.

When another oil reservoir 7 is located in the neighborhood of the oil reservoir 6, the displacement agent is injected into the oil reservoir 7, after previously being separated from the water in a separator 8, dried in the drying unit 3 and compressed in the station 4. The withdrawn water together with the displacement agent after separation may be injected into the oil reservoir 7, in a continuous water injection process.

Towards the end of the miscible displacement process of oil through non-illustrated wells of the reservoir 7, there is withdrawn, as mentioned above, the displacement agent and the injection water. After separation, drying and compression, the displacement agent is injected into another oil reservoir 8 in which the conventional continuous injection of water subsequently takes place.

If the oil reservoirs 6 and 7 and 8 are of approximately equal sizes, injecting in the oil reservoir 6 an amount of displacement agent equal to 30% of the porous volume of saturated hydrocarbons, then in the oil reservoir 7 there could be injected an amount of displacement agent equal to 24% of the porous volume of saturated hydrocarbons of this reservoir, and in the oil reservoir 8 there could be injected an amount of displacement agent equal to 19% of the porous volume of saturated hydrocarbons of this reservoir.

Taking into account that for each of the oil reservoirs 6, 7 and 8 which are of approximately equal sizes, one would use a displacement agent amount equal to 20% of the porous volume of saturated hydrocarbons, it results in a displacement agent amount for the three oil reservoirs 6, 7 and 8 of 60% of the porous volume of saturated hydrocarbons of a single reservoir, while by means of the displacement agent recovery method the displacement agent amount for the oil reservoirs 6, 7 and 8 is only 30% of the porous volume of saturated hydrocarbons of a single reservoir. At the same time in this last case the efficiency of the miscible displacement process is increased as instead of a displacement agent amount equal to 20% of the porous volume of saturated hydrocarbons being injected in each of the oil reservoirs 6, 7 and 8, a greater displacement agent amount equal to respectively 30% and 24% of the porous volume of saturated hydrocarbons is, in fact, injected. At the end, an amount of displacement agent will be withdrawn from the oil reservoir 8, an amount which could be used for other purposes, such as, for instance, for industry, or as a miscible displacement agent.

If near by the oil reservoir 6, there is no oil reservoir to which the displacement agent used for the oil reservoir 6 could be applied, the recovered displacement agent could be used for other industrial purposes.

EXAMPLE 2

According to another working example of the invention, one proceeds as in Example 1 with the difference that instead of the high purity displacement agent—over 80% of the volume—there is used a mixture of displacement agent with impurities, such as carbon dioxide with over 20% methane or ammonia, or other gaseous impurities, so that for proceeding with the miscible displacement process in the oil reservoir 6, one needs, generally, a higher injection pressure for the agent injection. After the injection and recovery of the agent from the oil reservoir 6, the injection pressure in the oil reservoir 7 and in the oil reservoir 8 decreases, because the miscibility agent pressure also decreases, as the displacement agent becomes more pure, the impurities generally become more miscible with the oil, and are separated during the miscible displacement process, being withdrawn together with the oil.

It is in this way that gaseous mixtures may be separated for industrial uses. For instance, by injecting in the oil reservoir 6 a mixture of 40% $CO_2$ and 60% $CH_4$, $CO_2$ of a high purity, over 90% of the volume, will be withdrawn.

The process, according to the invention, presents the following advantages:

- it makes possible the recovery of the miscible displacement agent from an oil reservoir;
- it allows the reduction of about 50% of the total displacement agent amount while increasing at the same time the efficiency of the miscible displacement process by injecting larger initial displacement agent amounts;
- it allows the displacement agent purification from a mixture of displacement agent with impurities;
- a relatively easy application in field conditions;
- it considerably decreases pollution.

We claim:

1. A method of recovering oil from at least one oil reservoir by the miscible displacement process, said method comprising the steps of:

(a) injecting gaseous carbon dioxide mixed with at least 20% of impurities selected from the group consisting of methane or other gaseous impurities capable of increasing the miscibility thereof as a miscible displacement agent into a first oil reservoir region through at least one well thereof at a first pressure enabling miscibility at the respective oil composition and temperature;

(b) thereafter injecting water into said first oil reservoir region through at least one well thereof whereby oil is displaced from the porous structure of said region and, toward the end of the oil displacement, said displacement agent is present in residual saturation in said region at least partly dissolved in water.

(c) then withdrawing said displacement agent and water containing said displacement agent from said first oil reservoir region through at least one well thereof;

(d) separating the displacement agent withdrawn in step (c) from water and compressing same;

(e) injecting a portion of the compressed displacement agent separated in step (d) as a miscible displacement agent into a second oil reservoir region at a second pressure lower than said first pressure through at least one well thereof, thereby enabling miscibility at the respective oil composition and temperature, and repeating steps (b), (c) and (d) therewith; and (f) injecting a portion of the compressed displacement agent recovered from said second oil reservoir region as a miscible displacement agent into a third oil reservoir region at a third pressure lower than said second pressure through at least one well thereof, thereby enabing miscibility at the respective oil composition and temperature, and repeating steps (b), (c) and (d) therewith .

2. The method defined in claim 1 wherein said first, second and third oil reservoir regions are formed in the same oil reservoir.

3. The method defined in claim 1 wherein said first, second and third oil reservoir regions are formed in different oil reservoirs.

4. The method defined in claim 2 or claim 3 wherein the displacement agent and the water containing the displacement agent are withdrawn from said first, second and third oil reservoir regions by natural flow, gaslift or deep-pumping, the displacement agent being separated from the water and then augmented by an additional amount of agent equal to any losses incurred thereby during the miscible displacement process, the displacement agent then being dried prior to compression.

5. The method defined in claim 4 wherein said first, second and third oil reservoir regions are of about equal dimension and an amount of displacement agent equal to 30% of the volume of the porous structure of said first oil reservoir region is injected therein and recovered therefrom and an amount of this recovered displacement agent equal to 24% of the volume of the porous structure of said second oil reservoir region is then injected therein and recovered therefrom and an amount of this recovered displacement agent equal to 19% of the volume of the porous structure of said third oil reservoir region is injected therein and recovered therefrom.

6. The method defined in claim 5 wherein said displacement agent contains a mixture of 40% $CO_2$ and 60% $CH_4$ and is injected into said first and second oil reservoir regions, the subsequently recovered displacement agent containing over 90% by volume of carbon dioxide.

* * * * *